US009958149B2

(12) United States Patent
You et al.

(10) Patent No.: US 9,958,149 B2
(45) Date of Patent: May 1, 2018

(54) LED LAMP WITH SPEAKER

(71) Applicant: SENGLED OPTOELECTRONICS CO., LTD., Tongxiang (CN)

(72) Inventors: Bo You, Tongxiang (CN); Chaoqun Sun, Tongxiang (CN); Jinxiang Shen, Tongxiang (CN)

(73) Assignee: SENGLED OPTOELECTRONICS CO., LTD., Tongxiang (CN)

( * ) Notice: Subject to any disclaimer, the term of this patent is extended or adjusted under 35 U.S.C. 154(b) by 0 days. days.

(21) Appl. No.: 15/108,809

(22) PCT Filed: Dec. 29, 2015

(86) PCT No.: PCT/CN2015/099379
§ 371 (c)(1),
(2) Date: Jun. 29, 2016

(87) PCT Pub. No.: WO2016/107538
PCT Pub. Date: Jul. 7, 2016

(65) Prior Publication Data

US 2016/0363312 A1 Dec. 15, 2016

(30) Foreign Application Priority Data

Dec. 29, 2014 (CN) ..... 2014 1 0840573

(51) Int. Cl.
*F21V 33/00* (2006.01)
*H04R 1/02* (2006.01)
(Continued)

(52) U.S. Cl.
CPC ..... *F21V 33/0056* (2013.01); *F21K 9/23* (2016.08); *F21K 9/232* (2016.08); *F21K 9/235* (2016.08);
(Continued)

(58) Field of Classification Search
CPC ... F21V 33/00; F21V 33/0052; F21V 33/0056
(Continued)

(56) References Cited

U.S. PATENT DOCUMENTS 7,604,378 B2 * 10/2009 Wolf ..... A01M 1/2083 362/227
8,299,903 B2 * 10/2012 Haase ..... F21V 33/0056 315/209 R
(Continued)

FOREIGN PATENT DOCUMENTS

CN 203384923 U 1/2014
CN 203395892 U 1/2014
(Continued)

OTHER PUBLICATIONS

The World Intellectual Property Organization (WIPO) International Search Report for PCT/CN2015/099379 dated Apr. 5, 2016.

*Primary Examiner* — Daniel St Cyr
(74) *Attorney, Agent, or Firm* — Anova Law Group, PLLC

(57) ABSTRACT

A light emitting diode (LED) lamp with at least one speaker is provided. The LED lamp includes a lamp base, a lamp cup installed on the lamp base, and a lamp socket installed under the lamp base. The LED lamp also includes a lamp plate installed on a top surface of the lamp cup, and a plurality of LEDs, set on the lamp plate, configured to emit light. Further, the LED lamp includes the at least one speaker, set at an outer surface of the lamp cup, configured to play audio signals. The top surface of the lamp cup including the lamp plate and the outer surface of the lamp cup including the at least one speaker are not coplanar.

15 Claims, 2 Drawing Sheets

(51) Int. Cl.

| | |
|---|---|
| ***F21K 9/23*** | (2016.01) |
| ***F21K 9/232*** | (2016.01) |
| ***F21K 9/235*** | (2016.01) |
| ***F21V 3/00*** | (2015.01) |
| ***F21V 19/00*** | (2006.01) |
| *F21Y 115/10* | (2016.01) |
| *H05B 37/02* | (2006.01) |

(52) U.S. Cl.
CPC ..... *F21V 3/00* (2013.01); *F21V 19/006* (2013.01); *H04R 1/028* (2013.01); *F21Y 2115/10* (2016.08); *H05B 37/0272* (2013.01)

(58) Field of Classification Search
USPC ..... 362/253, 254
See application file for complete search history.

(56) References Cited

U.S. PATENT DOCUMENTS

| | | | | |
|---|---|---|---|---|
| 8,847,491 | B2 * | 9/2014 | Yotsumoto ..... | F21V 33/0056 315/149 |
| 2006/0039570 | A1 | 2/2006 | Yeh | |
| 2009/0207607 | A1 | 8/2009 | Haase et al. | |

FOREIGN PATENT DOCUMENTS

| | | | |
|---|---|---|---|
| JP | 2004328678 | A | 11/2004 |
| JP | 2013120728 | A | 6/2013 |

* cited by examiner

LED LAMP WITH SPEAKER

CROSS-REFERENCES TO RELATED APPLICATIONS

This PCT patent application is a national phase entry under 35 U.S.C. § 371 of International Application No. PCT/CN2015/099379, filed on Dec. 29, 2015, which claims priority to Chinese Patent Application No. 201410840573.5, filed on Dec. 29, 2014, the entire contents of which are incorporated herein by reference.

FIELD OF THE INVENTION

The present disclosure generally relates to light emitting diode (LED) lighting technology and, more particularly, relates to an LED lamp with at least one speaker.

BACKGROUND

Light emitting diode (LED) is a solid state semiconductor device that can convert electrical energy into visible light. LED lamps may generally provide advantages in energy conservation, environmental protection, controllable lighting, solid state lighting, and long operational lifetime. Thus, the LED lamps have been widely used in various areas for public, commercial, and/or indoor lighting in a low carbon life. The LED lighting is the development trend of high efficiency green lighting. The unique power and control method of the LED lamps makes it very easy to integrate some intelligent control and multimedia functions.

Speakers play an important role in modern daily life entertainment. To provide lighting and play music at the same time, current LED lamp and speaker designs combine speakers and LEDs into one integrated device. In general, the designs of such devices often may place one speaker in the center of a lighting-emitting surface and set the LEDs at the periphery of the speaker to provide lighting and audio playing capabilities. Thus, an annular LED region is formed along the periphery of the speaker. However, because the speaker is set in the middle of the lighting-emitting surface, a dark area may exist in the middle of the lighting-emitting surface when the LED lamp with the speaker is turned on, affecting its lighting effects.

The disclosed LED lamps are directed to solve one or more problems set forth above and other problems.

BRIEF SUMMARY OF THE DISCLOSURE

One aspect of the present disclosure includes a light emitting diode (LED) lamp with at least one speaker. The LED lamp includes a lamp base, a lamp cup installed on the lamp base, and a lamp socket installed under the lamp base. The LED lamp also includes a lamp plate installed on a top surface of the lamp cup, and a plurality of LEDs, set on the lamp plate, configured to emit light. Further, the LED lamp includes the at least one speaker, set at an outer surface of the lamp cup, configured to play audio signals. The top surface of the lamp cup including the lamp plate and the outer surface of the lamp cup including the at least one speaker are not coplanar. A lamp shell including a first shell and a second shell.

Another aspect of the present disclosure includes a method for emitting light and playing audio signals by a light emitting diode (LED) lamp with at least one speaker. The method includes installing a lamp cup on a lamp base, and installing a lamp socket under the lamp base. The method also includes installing a lamp plate on a top surface of the lamp cup and emitting light through a plurality of LEDs set on the lamp plate. Further, the method includes playing audio signals through the at least one speaker set at an outer surface of the lamp cup, wherein the top surface of the lamp cup including the lamp plate and the outer surface of the lamp cup including the at least one speaker are not on a same plane.

Other aspects of the present disclosure can be understood by those skilled in the art in light of the description, the claims, and the drawings of the present disclosure.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

Reference will now be made in detail to exemplary embodiments of the disclosure, which are illustrated in the accompanying drawings. Wherever possible, the same reference numbers will be used throughout the drawings to refer to the same or like parts.

Figure 1:
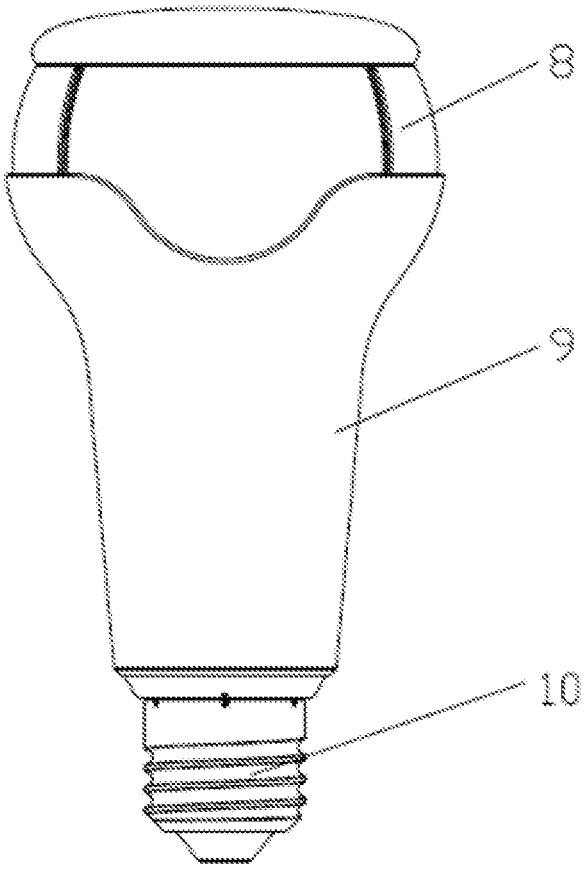
FIG. 1 illustrates a schematic diagram of an exemplary LED lamp with at least one speaker consistent with the disclosed embodiments.
Figure 2:
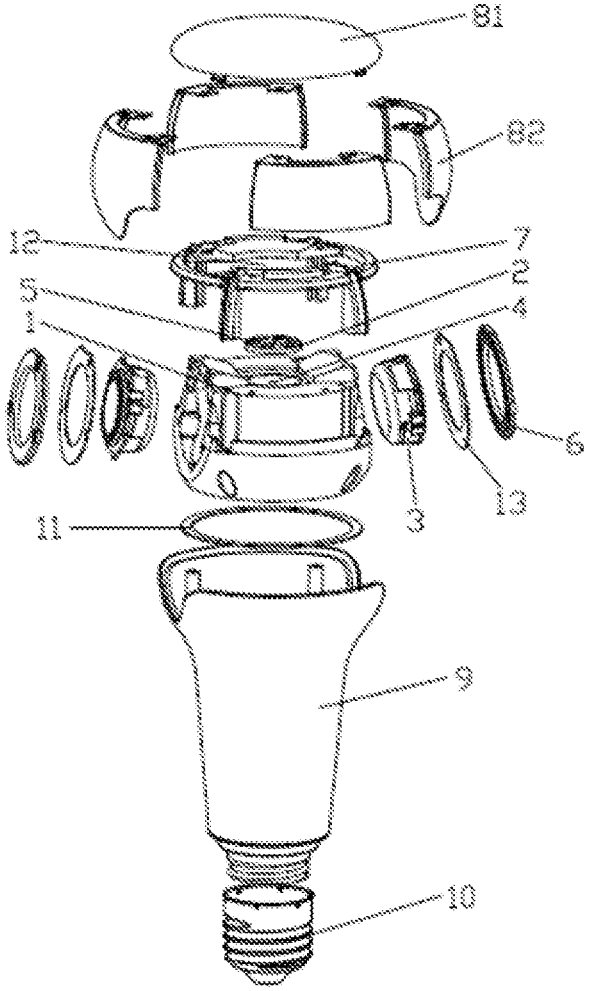
FIG. 2 illustrates an exploded view from another viewpoint of an exemplary LED lamp with at least one speaker consistent with the disclosed embodiments.

FIG. 1 illustrates a schematic diagram of an exemplary LED lamp with at least one speaker consistent with the disclosed embodiments. FIG. 2 illustrates an exploded view from another viewpoint of an exemplary LED lamp with at least one speaker consistent with the disclosed embodiments. As shown in FIG. 1 and FIG. 2, the LED lamp with at least one speaker may include a lamp shell 8, a lamp plate 2, a lamp cup 1, a lamp base 9, a lamp socket 10 and at least one speaker 3. A power supply module (not shown in FIG. 1 and FIG. 2) may be configured to supply power to the LED lighting unit and speaker. In one embodiment, two speakers are included in the LED lamp.

Specifically, the lamp plate 2 is installed on a top surface 4 of the lamp cup 1. A plurality of LEDs 5 are set on the lamp plate 2. The two speakers 3 are installed at an outer surface of the lamp cup 1, respectively. The top surface 4 including the lamp plate 2 and the outer surface including the two speakers 3 are not on a same plane. The speaker 3 is fixed on the lamp cup 1 through a speaker fixing plate 6. A speaker gasket 13 is set between the speaker 3 and the speaker fixing plate 6.

Further, the LED lamp with at least one speaker may also include a supporting ring 7 and a lamp shell 8. The supporting ring 7 is installed above the lamp cup 1. The lamp shell 8 is fixed on the supporting ring 7 through a connection part. A hollow structure that contains the lamp cup 1 is formed by the lamp shell 8 fixed on the supporting ring 7. The hollow structure has an opening at the lower end. The lamp base 9 is set under the lamp cup 1. The lower part of the lamp base 9 is connected to the lamp socket 10. An opening at the upper end of the lamp base 9 is matched with the opening at the lower end of the hollow structure.

Moreover, the LED lamp with at least one speaker may also include a gasket 11 set on the bottom of the lamp cup 1.

Specifically, the lamp shell 8 includes a first shell 81 and a second shell 82. The first shell 81 is connected to the second shell 82 through the connection part. The first shell 81 and the second shell 82 together form the hollow structure that contains the lamp cup 1. The connection part may be a snap, glue, etc. The first shell 81 is a transparent lampshade. The transparent lampshade is set directly above the supporting ring 7. A hole 12 which is matched with the lamp plate 2 is set in the center of the supporting ring 7. The plurality of LEDs 5 set on the lamp plate 2 illuminate through the hole 12 and the transparent lampshade. The whole second shell 82 may be a mesh structure. In one example, the part of the second shell 82 that covers the speaker 3 is a mesh structure. The second shell 82 may be one piece or multiple slices. Several pieces of the second shell 82 are fixed respectively on the supporting ring 7, thus forming an annular structure. In some embodiments, the second shell 82 may be other opaque structures so that the speaker 3 and related components are not visible by a user. In some embodiments, the second shell 82 may be transparent structures so that the speaker 3 and related components are visible by a user. In some embodiments, some of the multiple pieces of the second shell 82 may be transparent structures and other may be opaque structures for form a lamp with visual interest.

The at least one speaker may be set at the outer surface of the lamp cup 1. The outer surface including the speakers and the lighting surface including the lamp plate are not on a same plane. In one embodiment, the lighting surface including the lamp plate may be perpendicular to the outer surface on which the speaker locates. In other embodiments, the lighting surface including the lamp plate may an acute or obtuse angle with the outer surface on which the speaker locates. Therefore, a dark area would not appear due to the location of the at least one speaker, thus improving the lighting effects.

In some embodiments consistent with the present disclosure, a plurality of speakers may be mounted on the lamp cup 1. The speakers may be mounted on one or more of the outer surfaces of the lamp cup 1. The outer surfaces including the speakers and the lighting surface including the lamp plate are not coplanar.

In some embodiments consistent with the present disclosure, a plurality of positions (plug-in holes) for speakers may be prepared on the outer surfaces of lamp cup 1. A user may determine to adjust the position of the speakers on the lamp cup 1 by choosing from the plurality of prepared speaker positions on one or more of the outer surfaces of the lamp cup 1. The outer surfaces including the speakers and the lighting surface including the lamp plate are not coplanar.

In some embodiments, an RF module may be added to the LED lamp with the at least one speaker. The RF module may enable users to control the LED lamp and the at least one speaker remotely, such as switching the lamp on/off, adjusting light and sound settings, etc. The RF module may also connect the LED lamp and the at least one speaker to the internet to stream music online. The RF module may be installed, for example, inside lamp base 9.

In some embodiments, a Bluetooth module may be included in the LED lamp with the at least one speaker. The LED lamp and the at least one speaker may be paired with a smart phone, a tablet, etc. through the Bluetooth module. A user may install an application on the smartphone or tablet to control lighting or play music stored on the device. The Bluetooth module may be installed, for example, inside lamp base 9.

In some embodiments, a control unit may be installed in lamp base 9. The control unit may be connected to the LEDs and the speakers 3. Through the controller, the LED lamp may be configured to change its light colors or light intensities according to the rhythm or volume of the music played through the at least one speaker.

Although this disclosure may be expanded using various forms of modifications and alternations, the specification also lists a number of specific embodiments to explain in detail. It should be understood that the purpose of the inventor is not to limit the disclosure to the specific embodiments described herein. On the contrary, the purpose of the inventor is to protect all the improvements, equivalent conversions and modifications based on spirit or scope defined by the claims in the disclosure. The same reference numbers may be used throughout the drawings to refer to the same or like parts. In addition, the term "include" does not exclude other modules or steps. Words importing the singular only also include the plural. Various modules or devices disclosed in this disclosure may be implemented by one module or device through software or hardware.

INDUSTRIAL APPLICABILITY AND ADVANTAGEOUS EFFECTS

Without limiting the scope of any claim and/or the specification, examples of industrial applicability and certain advantageous effects of the disclosed embodiments are listed for illustrative purposes. Various alternations, modifications, or equivalents to the technical solutions of the disclosed embodiments can be obvious to those skilled in the art and can be included in this disclosure.

Comparing with the existing technology, because at least one speaker is set at the outer surface of a lamp cup, and the outer surface including the at least one speaker and the lighting surface including a lamp plate are not on a same plane, there is no dark area when the LED lamp with the at least one speaker is turned on, thus improving the lighting effects.

REFERENCE SIGN LIST

Lamp cup 1
Lamp plate 2
Speaker 3
Top surface 4 of the lamp cup 1
Light emitting diode (LED) 5
Speaker fixing plate 6
Supporting ring 7
Lamp shell 8
First shell 81
Second shell 82
Lamp base 9
Lamp socket 10
Gasket 11
Hole 12
Speaker gasket 13

What is claimed is:

1. A light emitting diode (LED) lamp with at least one speaker, comprising:

a lamp base including a top opening;

a lamp cup installed onto the top opening of the lamp base, the at least one speaker being set on an outer surface of the lamp cup;

a lamp socket installed under the lamp base;

a lamp plate installed on a top surface of the lamp cup;

a plurality of LEDs, set on the lamp plate, configured to emit light; and a lamp shell including a first shell and a second shell combined to cover the top opening of the lamp base, wherein:

the plurality of LEDs and the at least one speaker are integrated into the lamp cup; and the outer surface of the lamp cup including the at least one speaker and the top surface of the lamp cup including the lamp plate remain an angle so as to reduce a dark area of the plurality of LEDs.

2. The LED lamp according to claim 1, wherein:

the at least one speaker is fixed on the lamp cup through a speaker fixing plate; and a speaker gasket is set between the speaker fixing plate and the at least one speaker.

3. The LED lamp according to claim 1, wherein:

a supporting ring is set above the lamp cup;

the lamp shell is connected to the supporting ring through a connection part;

the lamp shell fixed on the supporting ring forms a hollow structure that contains the lamp cup; and an opening exists at the bottom of the hollow structure.

4. The LED lamp according to claim 3, wherein:

a lower part of the lamp base is connected to the lamp socket; and an upper part of the lamp base is matched with the opening at the lower end of the hollow structure.

5. The LED lamp according to claim 3, wherein:

the first shell is connected to the second shell through a snap to form the hollow structure that contains the lamp cup;

the first shell is a transparent lampshade installed directly above the supporting ring;

a hole which is matched with the lamp plate is set in the center of the supporting ring;

the plurality of LEDs set on the lamp plate illuminate through the hole and the transparent lampshade; and at least a part of the second shell covering the at least one speaker is a mesh structure.

6. The LED lamp according to claim 5, wherein:

the second shell is an annular structure.

7. The LED lamp according to claim 6, wherein:

the second shell is a sliced structure; and several slices of the second shell fixed on the supporting ring are integrated into one piece to form the annular structure.

8. A method for emitting light and playing audio signals by a light emitting diode (LED) lamp with at least one speaker, comprising:

installing a lamp cup on a lamp base;

installing a lamp socket under the lamp base;

installing a lamp plate on a top surface of the lamp cup;

providing light through a plurality of LEDs set on the lamp plate; and playing audio signals through the at least one speaker set on an outer surface of the lamp cup, wherein the plurality of LEDs and the at least one speaker are integrated into the lamp cup, and the top surface of the lamp cup including the lamp plate and the outer surface of the lamp cup including the at least one speaker remain an angle so as to reduce a dark area of the plurality of LEDs.

9. The method according to claim 8, comprising:

fixing the at least one speaker on the lamp cup through a speaker fixing plate; and setting a speaker gasket between the speaker fixing plate and the at least one speaker.

10. The method according to claim 8, comprising:

setting a supporting ring above the lamp cup, wherein a lamp shell is connected to the supporting ring through a connection part; the lamp shell fixed on the supporting ring forms a hollow structure that contains the lamp cup; and an opening exists at the bottom of the hollow structure.

11. The method according to claim 10, wherein:

an lower part of the lamp base is connected to the lamp socket; and an upper part of the lamp base is matched with the opening at the lower end of the hollow structure.

12. The method according to claim 10, wherein the lamp shell includes the first shell and the second shell.

13. The method according to claim 12, comprising:

connecting the first shell to the second shell through a snap to form the hollow structure that contains the lamp cup; wherein the first shell is a transparent lampshade;

placing the transparent lampshade above the supporting ring;

setting a hole which is matched with the lamp plate the center of the supporting ring; wherein the plurality of LEDs set on the lamp plate illuminate through the hole and the transparent lampshade; and covering, by at least part of the second shell, the at least one speaker is a mesh structure.

14. The method according to claim 13, wherein:

the second shell is an annular structure.

15. The method according to claim 14, wherein:

the second shell is a sliced structure; and the method further comprises:

integrating several slices of the second shell fixed on the supporting ring into one piece to form the annular structure.

* * * * *